US010465443B2

(12) United States Patent
Huang et al.

(10) Patent No.: US 10,465,443 B2
(45) Date of Patent: Nov. 5, 2019

(54) SPRING WINDING TYPE WINDOW SHADE

(71) Applicant: CHING FENG HOME FASHIONS CO., LTD., Changhua County (TW)

(72) Inventors: Chien-Chih Huang, Changhua County (TW); Wei-Ming Shih, Changhua County (TW)

(73) Assignee: CHING FENG HOME FASHIONS CO., LTD., Fuxing Township, Changhua County (TW)

( * ) Notice: Subject to any disclaimer, the term of this patent is extended or adjusted under 35 U.S.C. 154(b) by 175 days.

(21) Appl. No.: 15/674,754

(22) Filed: Aug. 11, 2017

(65) Prior Publication Data

US 2019/0048657 A1 Feb. 14, 2019

(51) Int. Cl.
*E06B 9/42* (2006.01)
*E06B 9/66* (2006.01)

(52) U.S. Cl.
CPC . *E06B 9/42* (2013.01); *E06B 9/66* (2013.01)

(58) Field of Classification Search
CPC ..... E06B 9/66; E06B 9/78; E06B 2009/785; E06B 9/64
USPC ..... 160/245
See application file for complete search history.

(56) References Cited

U.S. PATENT DOCUMENTS 827,000 A * 7/1906 Dinsmore ..... E06B 9/78 160/349.2
1,407,624 A * 2/1922 Bailey ..... E06B 9/66 160/278
2,336,899 A * 12/1943 Stern ..... E06B 9/64 160/243
3,750,995 A * 8/1973 Genger ..... G03B 21/58 160/23.1
4,433,711 A * 2/1984 Lew ..... E06B 9/40 160/120
4,809,760 A * 3/1989 Lew ..... E06B 9/40 160/120
5,158,127 A * 10/1992 Schumacher ..... B60J 1/2091 160/368.1
5,996,674 A * 12/1999 Gatewood ..... A47H 13/14 160/113
6,176,028 B1 * 1/2001 Walsh ..... G09F 11/21 160/121.1
7,350,556 B2 * 4/2008 Pernicano ..... E04H 15/32 135/120.1

(Continued)

*Primary Examiner* — Catherine A Kelly
*Assistant Examiner* — Abe Massad
(74) *Attorney, Agent, or Firm* — Muncy, Geissler, Olds & Lowe, P.C.

(57) ABSTRACT

A spring winding type window shade includes a headrail providing a first fastening device, a curtain having a second fastening device located at one end thereof and fastened to the first fastening device of the headrail, scroll springs longitudinally and tightly bonded to the curtain with respective one ends thereof fastened to the second fastening device of the curtain, and a clamp for clamping the respective opposite ends of the curtain and scroll springs remote from the headrail so that the curtain and the scroll springs can be received in an accommodation space in the clamp in a rolled up condition. When pressing a press portion of the clamp, the clamp is opened, allowing the curtain to be rolled up or extended out with the scroll springs. When release the applied pressure from the press portion, the clamp automatically clamps the curtain and the scroll springs again.

3 Claims, 7 Drawing Sheets

(56) References Cited

U.S. PATENT DOCUMENTS

| | | | | |
|---|---|---|---|---|
| 8,096,340 | B2 * | 1/2012 | McCarty | E06B 9/32 160/168.1 R |
| 8,100,697 | B2 * | 1/2012 | Budryk | B43L 1/00 434/412 |
| 2005/0045284 | A1 * | 3/2005 | Ullyett | E04H 15/32 160/238 |
| 2009/0308545 | A1 * | 12/2009 | An | E06B 9/42 160/313 |
| 2011/0155199 | A1 * | 6/2011 | Harper | E04H 15/32 135/143 |
| 2017/0096854 | A1 * | 4/2017 | Lichtman | E04F 10/0607 |

* cited by examiner

SPRING WINDING TYPE WINDOW SHADE

BACKGROUND OF THE INVENTION

1. Field of the Invention

The present invention relates to window shade technology and more particularly, to a spring winding type window shade.

2. Description of the Related Art

Regular window shades are generally equipped with an exposed or hidden type lift cord system that is operable to roll up or let off the shade body. Either using the exposed type or hidden type lift cord system, the installation of a conventional window shade is not convenient. More particularly, when using a lift cord-based window shade, there is a security concern.

Therefore, it is expected to provide a measure that effectively improves window shade installation convenience and enhances window shade winding or extending operational safety.

SUMMARY OF THE INVENTION

The present invention has been accomplished under the circumstances in view. It is the main object of the present to provide a spring winding type window shade, which improves installation convenience and enhances winding or extending operational safety.

To achieve this and other objects of the present invention, a spring winding type window shade comprises a headrail comprising a first fastening means, a curtain comprising a top end, an opposing bottom end, a second fastening means located at the top end to face toward the first fastening means of the headrail and adapted for fastening to the first fastening means of the headrail, at least one elastic means bonded to the curtain with one end thereof fixedly fastened to the second fastening means of the curtain, and a clamp comprising a support arm, a clamping arm and a press portion. The clamping arm has one end thereof connected to one end of the support arm, and an opposite end thereof clamped on an opposite end of the support arm such that an accommodation space is defined in between the support arm and the clamping arm. The press portion is connected to a body part of the clamping arm to face toward the support arm. The clamp is adapted for clamping the curtain and an opposite end of each elastic means remote from the headrail for allowing the curtain and the at least one elastic means to be received in the accommodation space of the clamp in a rolled up condition. When pressing the press portion of the clamp, the clamping arm is opened from the support arm for allowing the curtain to be rolled up or extended out with the at least one elastic means. When releasing the applied pressure from the press portion, the clamping arm is clamped on the support arm again to secure the curtain and the at least one elastic means in a predetermined condition.

In one embodiment of the present invention, the spring winding type window shade further comprises a bracket mounted between the headrail and the curtain. The first fastening means of the headrail is mounted at an outer sidewall of the headrail. The second fastening means of the curtain is disposed to face toward the first fastening means of the headrail. The bracket has one segment thereof bonded to the bottom surface of the headrail. A first fastener is directly inserted through the bottom surface of the headrail to affix the bracket to the headrail. A second fastener is inserted through the curtain and the at least one elastic means to affix an opposite segment of the bracket to the curtain and the at least one elastic means.

In another embodiment of the present invention, the spring winding type window shade further comprises a bracket mounted between the headrail and the curtain. The curtain and the at least one elastic means have respective one ends thereof fastened to one segment of the bracket and the headrail by a first fastener. The bracket has an opposite segment thereof fastened to the curtain and the at least one elastic means by a second fastener.

In still another embodiment of the present invention, the spring winding type window shade further comprises a bracket mounted between the headrail and the at least one elastic means. The curtain and the at least one elastic means have respective one ends thereof fastened to one segment of the bracket and the headrail by a first fastener. The bracket has an opposite segment thereof fastened to the curtain and the at least one elastic means by a second fastener.

Preferably, the spring winding type window shade further comprises a slat. The curtain and the at least one elastic means have respective opposite ends thereof fastened to and winding around the slat. The clamp is adapted for clamping the slat and the respective opposite ends of the curtain and the at least one elastic means remote from the headrail.

Other advantages and features of the present invention will be fully understood by reference to the following specification in conjunction with the accompanying drawings, in which like reference signs denote like elements, components, objects, structures, systems, architectures, means, flows, methods or steps.

DETAILED DESCRIPTION OF THE INVENTION

Figure 1:
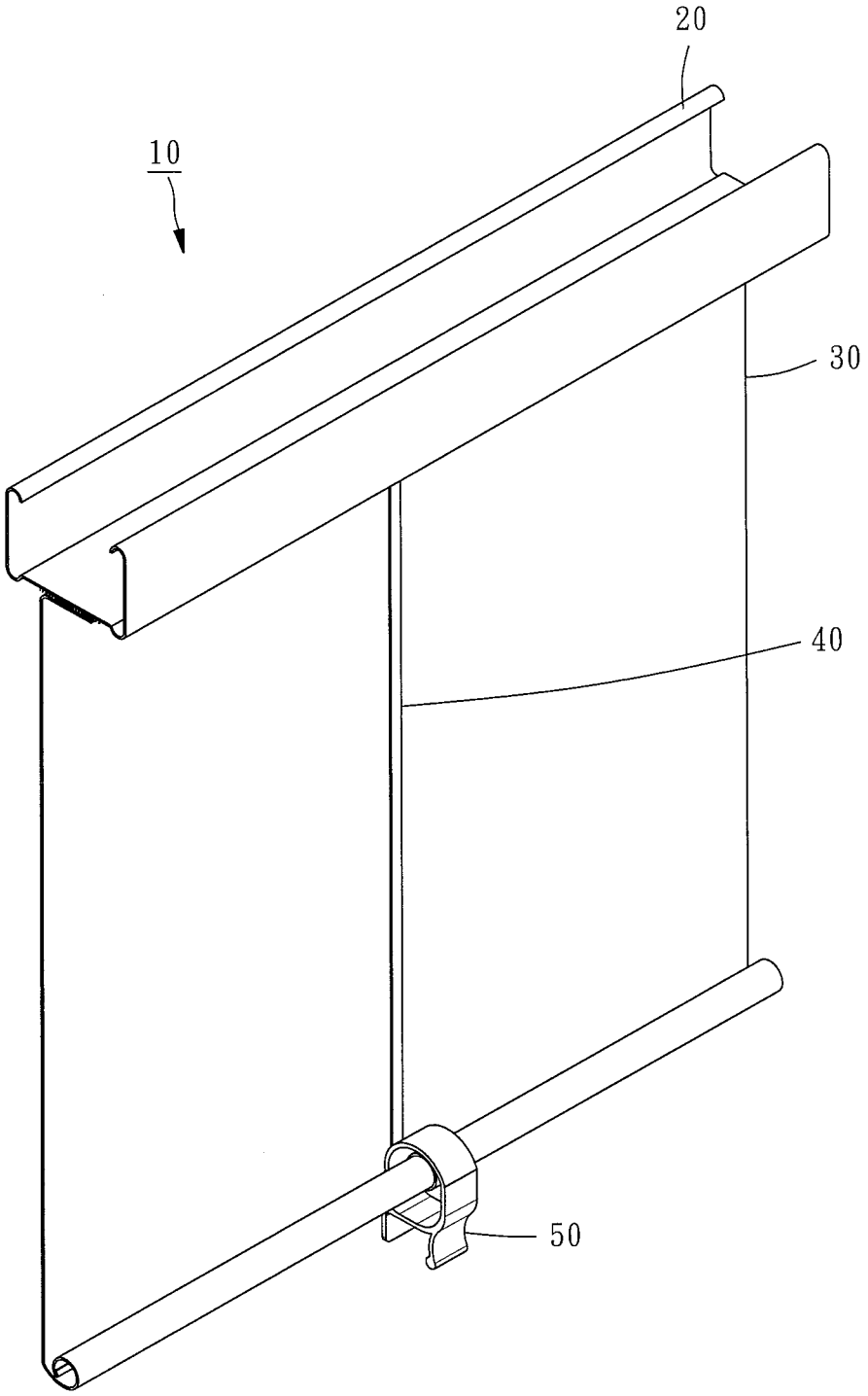
FIG. 1 is an oblique top elevational view of a spring winding type window shade in accordance with a first embodiment of the present invention.

Referring to FIGS. 1-4, a spring winding type window shade 10 in accordance with a first embodiment of the present invention is shown. The spring winding type window shade 10 comprises a headrail 20, a curtain 30, two elastic means 40, a clamp 50 and an L-shaped bracket 60.

The headrail 20 is adapted for mounting at a wall (not shown) or window frame (not shown), comprising a bottom surface 202 and a first fastening means 21 located on the bottom surface 202.

The curtain 30 comprises a second fastening means 31 located on one end thereof that faces toward the headrail 20. The second fastening means 31 is disposed corresponding to the location of the first fastening means 21 of the headrail 20 so that the second fastening means 31 is fastened to the first fastening means 21 of the headrail 20. It's worth mentioning that, the first fastening means 21 and the second fastening means 31 are Velcro tapes (velour and crochet; hook and loop materials). Adhesive can be selectively used for fastening the second fastening means 31 to the first fastening means 21.

The elastic means 40 are mounted at the bottom surface 202 of the headrail 20, and bonded to opposing front and back surfaces of the curtain 30. Each elastic means 40 has one end thereof affixed to the curtain 30 at the second fastening means 31. Further, each elastic means 40 is longitudinally and tightly bonded to the curtain 30 and extends in direction away from the second fastening means 31 of the curtain 30. In this embodiment, the two elastic means 40 are scroll springs. Alternatively, the at least one elastic means 40 can simply be bonded to the curtain 30. In general, the above description is not intended to limit the technical characteristics of the present invention.

The clamp 50 comprises a support arm 51, a clamping arm 52 and a press portion 53. The clamping arm 52 has one end thereof connected to one end of the support arm 51, and an opposite end thereof clamped on an opposite end of the support arm 51 so that an accommodation space 55 is defined between the support arm 51 and the clamping arm 52. The press portion 53 is connected to a part of the body of the clamping arm 52 and corresponds to the support arm 51. The clamp 50 is adapted for clamping the curtain 30 and the ends of the two elastic means 40 remote from the headrail 20. When the curtain 30 and the two elastic means 40 are rolled up, the rolled up part of the curtain 30 and elastic means 40 can be accommodated in the accommodation space 55 of the clamp 50. It is to be noted that the clamp 50 is made of plastic or metal having plasticity and pressure resistance, but it is not intended to limit the technical characteristics of the present invention.

The L-shaped bracket 60 is mounted between the headrail 20 and the curtain 30. The curtain 30 and the respective one ends of the two elastic means 40 are fastened to the bottom surface 202 of the headrail 20 by a first fastener 61 that inserted through one segment, namely, the horizontal segment of the L-shaped bracket 60. A second fastener 62 is inserted through an opposite segment, namely, the vertical segment of the L-shaped bracket 60, the curtain 30 and the two elastic means 40 to affix the curtain 30 and the two elastic means 40 to the L-shaped bracket 60.

Figure 2:
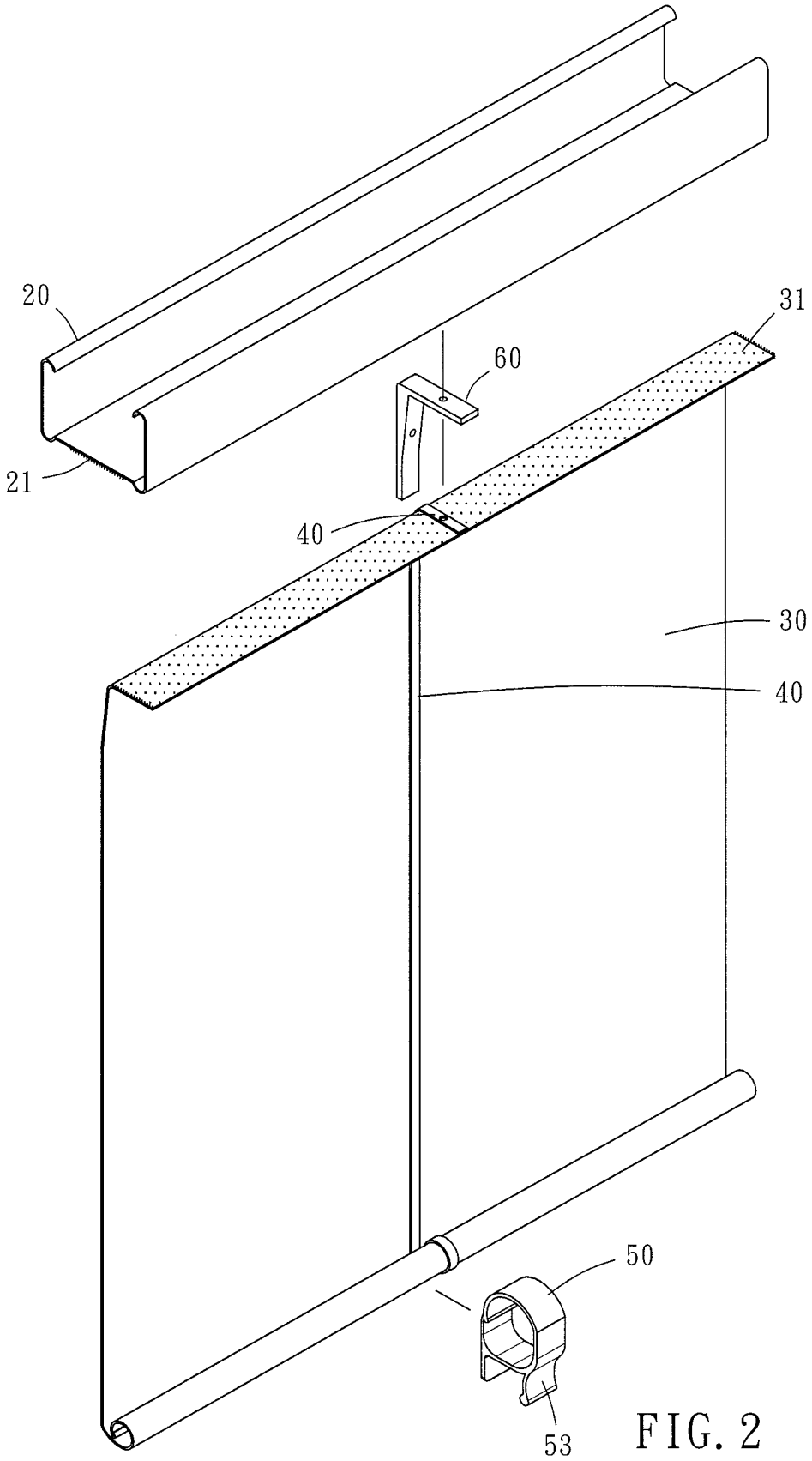
FIG. 2 is an exploded view of the spring winding type window shade in accordance with the first embodiment of the present invention.
Figure 3:
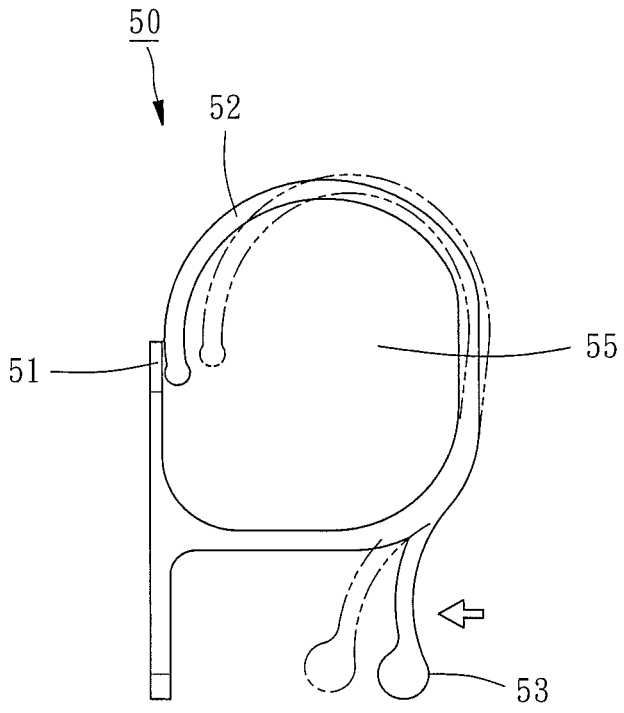
FIG. 3 is a schematic side view of the clamp of the spring winding type window shade in accordance with the first embodiment of the present invention.
Figure 4:
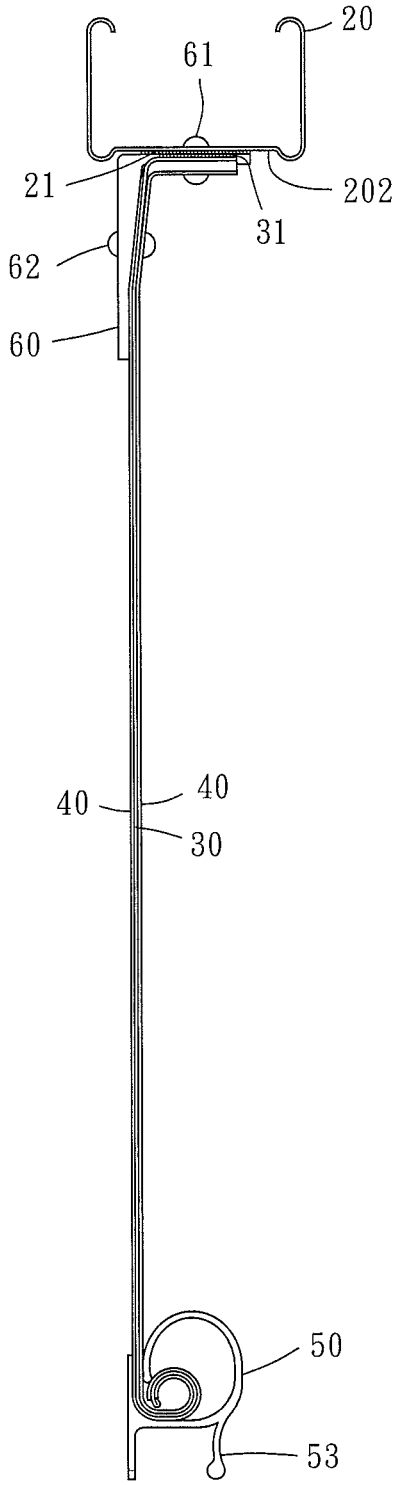
FIG. 4 is a schematic side view of the first embodiment of the present invention, illustrating the curtain and the elastic means in an extended status.

The first embodiment of the present invention achieves the effects as follows:

1. The invention provides convenience in structural installation. As illustrated in FIGS. 2 and 4, when the user is going to install the curtain 30 in the headrail 20, since the first fastening means 21 of the headrail 20 and the second fastening means 31 of the curtain 30 are Velcro tapes, the user simply needs to attach the second fastening means 31 of the curtain 30 to the first fastening means 21 of the headrail 20 to complete the installation. When compared to conventional techniques, the present invention provides significant convenient in installation.

Figure 5:
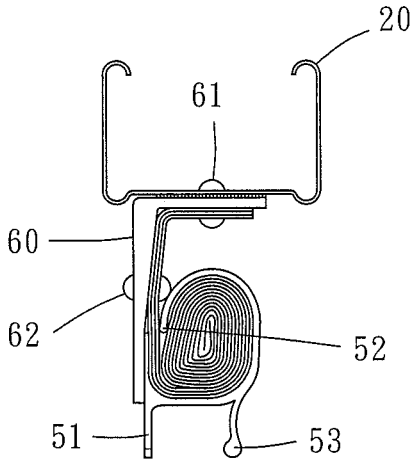
FIG. 5 is another schematic side view of the first embodiment of the present invention, illustrating the curtain and the elastic means received in a rolled up condition.

2. The invention provides the structural safety of a cordless window shade. As illustrated in FIGS. 1, 4 and 5, the two elastic means 40 are scroll springs tightly bonded to the opposing front and back surfaces of the curtain 30 and extended in a perpendicular manner relative to the bottom surface 202 of the headrail 20. When the user is going to extend out or roll up the spring winding type window shade 10, press the press portion 53 of the clamp 50 to release the clamping arm 52 from the support arm 51, allowing an open angle to be defined between the support arm 51 and the free end of the clamping arm 52. Subject to the auto-winding function of the two elastic means 40, the curtain 30 is automatically rolled up or can be smoothly extended out at this time. Preferably, the rolled up part of the curtain 30 and elastic means 40 is accommodated in the accommodation space 55 of the clamp 50. As soon as the curtain 30 and the two elastic means 40 are rolled up or extended out to a predetermined length, the user can then release the pressure from the press portion 53, allowing the support arm 51 and the clamping arm 52 to be automatically clamped together to secure the curtain 30 and the two elastic means 40 in the adjusted state. Thus, subject to the cordless structural characteristic of the spring winding type window shade 10, the winding or extending operational safety of the spring winding type window shade 10 is assured.

Figure 6:
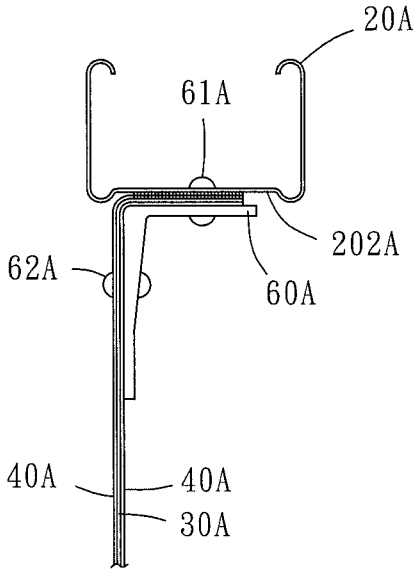
FIG. 6 is a schematic partial side view of a spring winding type window shade in accordance with a second embodiment of the present invention.

Referring to FIG. 6, a spring winding type window shade in accordance with a second embodiment of the present invention is shown. This second embodiment is substantially similar to the aforesaid first embodiment with the exceptions as follows:

The L-shaped bracket 60A is mounted between the headrail 20A and the elastic means 40A; the first fastener 61A is inserted through the horizontal segment of the L-shaped bracket 60A, the curtain 30A and respective one ends of the two elastic means 40A and the bottom surface 202A of the headrail 20A to affix the L-shaped bracket 60A, the curtain 30A and the two elastic means 40A to the headrail 20A; the curtain 30A and the two elastic means 40A are bonded to an outer side of the vertical segment of the L-shaped bracket 60A; the second fastener 62A is inserted through the curtain 30A and the two elastic means 40A to affix the curtain 30A and the two elastic means 40A to the L-shaped bracket 60A.

Figure 7:
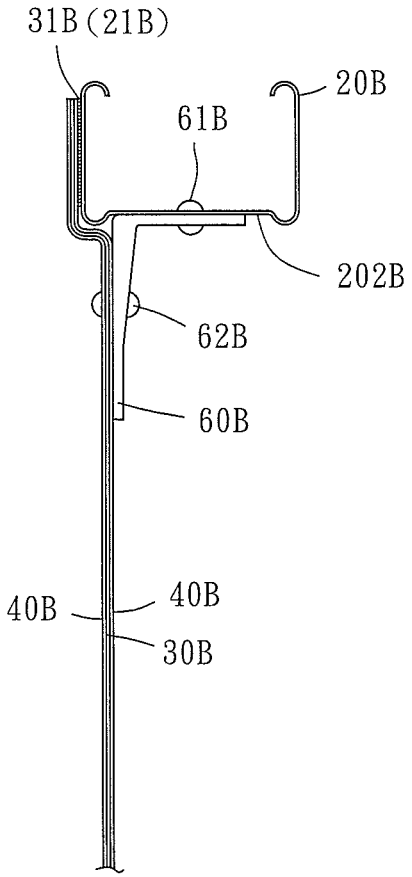
FIG. 7 is a schematic partial side view of a spring winding type window shade in accordance with a third embodiment of the present invention.

Referring to FIG. 7, a spring winding type window shade in accordance with a third embodiment of the present invention is shown. This third embodiment is substantially similar to the aforesaid first and second embodiments with the exceptions as follows:

The L-shaped bracket 60B has the horizontal segment thereof bonded to the bottom surface 202B of the headrail 20B; the first fastening means 21B of the headrail 20B is mounted at an outer sidewall 203B of the headrail 20B; the second fastening means 31B of the curtain 30B is disposed to face toward the first fastening means 21B of the headrail 20B and adapted for fastening to the first fastening means 21B of the headrail 20B. In this embodiment, the first fastener 61B is directly inserted through the bottom surface 202B of the headrail 20B to affix the horizontal segment of the L-shaped bracket 60B to the headrail 20B; the curtain 30B and the two elastic means 40B are bonded to an outer surface of the vertical segment of the L-shaped bracket 60B; the second fastener 62B is inserted through the curtain 30B, the two elastic means 40B and the L-shaped bracket 60B to affix the curtain 30B and the two elastic means 40B to the L-shaped bracket 60B.

Figure 8:
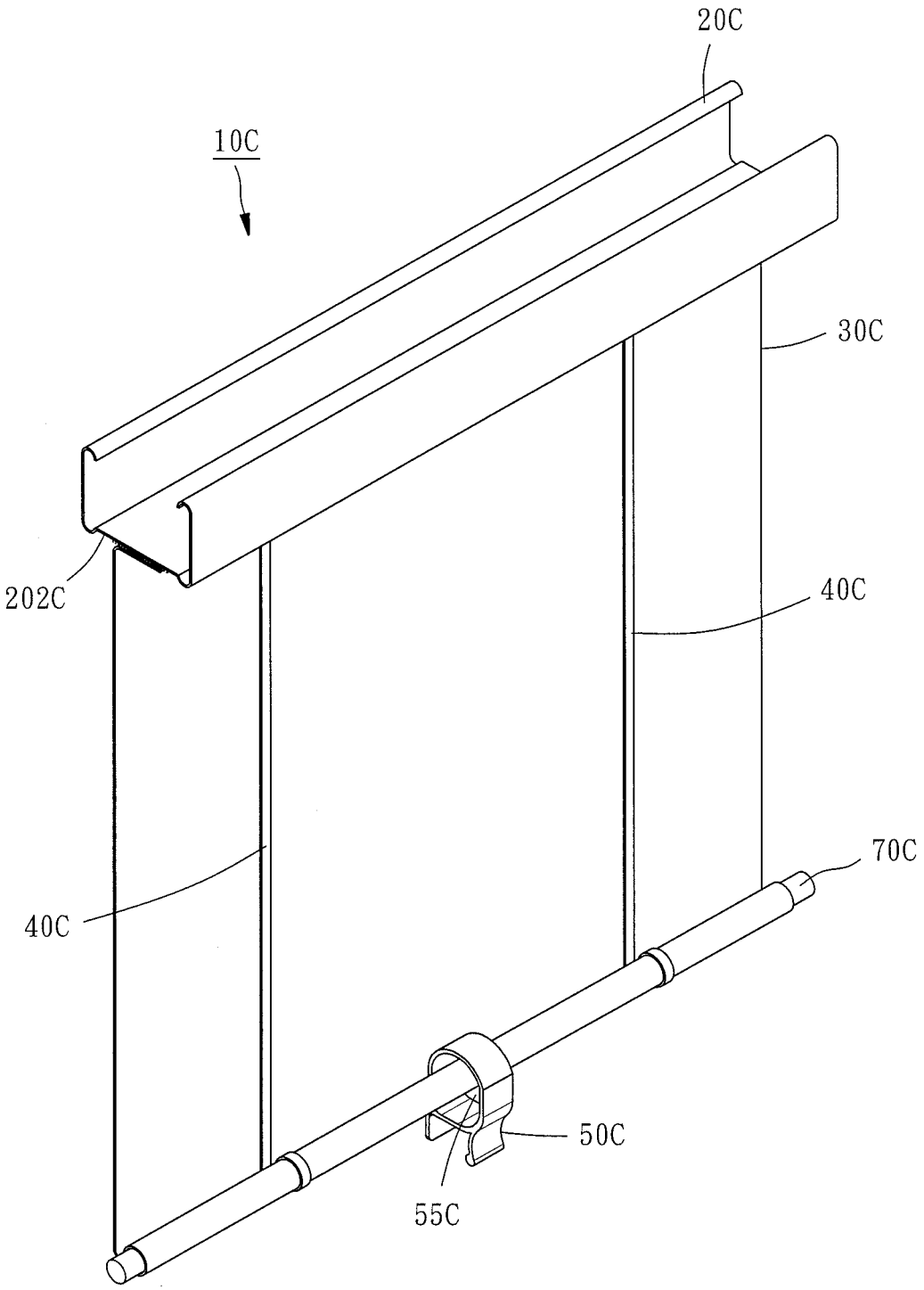
FIG. 8 is an oblique top elevational view of a spring winding type window shade in accordance with a fourth embodiment of the present invention.

Referring to FIG. 8, a spring winding type window shade in accordance with a fourth embodiment of the present invention is shown. This fourth embodiment is substantially similar to the aforesaid first, second and third embodiments with the exceptions as described hereinafter:

The two elastic means 40C have respective one ends thereof fastened to the bottom surface 202C of the headrail 20C and bonded to one same surface of the curtain 30C. The two elastic means 40C are directly and tightly bonded to the same surface of the curtain 30C, and extended in a perpendicular manner relative to the bottom surface 202C of the headrail 20C; similarly, the two elastic means 40C are scroll springs.

This fourth embodiment further comprises a slat 70C disposed in horizontal in parallel to the longitudinal axis of the headrail 20C. The respective other ends of the two elastic means 40C and the other end the curtain 30C remote from the headrail 20C are fastened to and rolled up around the slat 70C.

The clamp 50C is adapted for clamping the slat 70C, the curtain 30C and the other ends the two elastic means 40C remote from the headrail 20C. Similarly, when the curtain 30C and the two elastic means 40C are rolled up to a certain extent, the rolled up part of the curtain 30C and elastic means 40C can be accommodated in the accommodation space 55C of the clamp 50C.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A window shade, comprising:

a headrail comprising a first fastening member;

a curtain comprising a top end, an opposing bottom end, a second fastening member located at said top end to face toward said first fastening member of said headrail and adapted for fastening to said first fastening member of said headrail; wherein said first fastening member of said headrail is mounted at an outer sidewall of said headrail; said second fastening member of said curtain is disposed to face toward said first fastening member of said headrail;

at least one elastic member bonded to said curtain, each said elastic member having one end thereof fixedly fastened to said second fastening member of said curtain;

a clamp comprising a support arm, a clamping arm and a press portion, said clamping arm having one end thereof connected to one end of said support arm and an opposite end thereof clamped on an opposite end of said support arm such that an accommodation space is defined in between said support arm and said clamping arm, said press portion being connected to a body part of said clamping arm to face toward said support arm, said clamp being adapted for clamping said curtain and an opposite end of each said elastic member remote from said headrail for allowing said curtain and said at least one elastic member to be received in said accommodation space of said clamp in a rolled up condition;

a bracket mounted between said headrail and said curtain, said bracket has one segment thereof bonded to a bottom surface of said headrail and fixedly secured thereto by a first fastener that is directly inserted through said bracket and said bottom surface of said headrail to affix said bracket to said headrail; said bracket has an opposite segment thereof fastened to said curtain and said at least one elastic member by a second fastener that is inserted through said bracket, said curtain and each said elastic member to affix said curtain and said at least one elastic member to said bracket; and a slat, said curtain and each said elastic member have respective opposite ends thereof fastened to and winding around said slat; said clamp is adapted for clamping said slat and the respective opposite ends of said curtain and said at least one elastic member remote from said headrail;

wherein the clamp is configured such that pressing said press portion of said clamp toward said support arm causes said clamping arm to be opened, said curtain is rolled up or extended out with said at least one elastic member; and the clamp is further configured such that releasing the applied pressure from said press portion causes said clamping arm to be clamped on said support arm again to secure said curtain and said at least one elastic member in a predetermined condition.

2. A window shade, comprising:

a headrail comprising a first fastening member;

a curtain comprising a top end, an opposing bottom end, a second fastening member located at said top end to face toward said first fastening member of said headrail and adapted for fastening to said first fastening member of said headrail;

at least one elastic member bonded to said curtain, each said elastic member having one end thereof fixedly fastened to said second fastening member of said curtain;

a clamp comprising a support arm, a clamping arm and a press portion, said clamping arm having one end thereof connected to one end of said support arm and an opposite end thereof clamped on an opposite end of said support arm such that an accommodation space is defined in between said support arm and said clamping arm, said press portion being connected to a body part of said clamping arm to face toward said support arm, said clamp being adapted for clamping said curtain and an opposite end of each said elastic member remote from said headrail for allowing said curtain and said at least one elastic member to be received in said accommodation space of said clamp in a rolled up condition;

a bracket mounted between said headrail and said curtain; wherein said curtain and each said elastic member have respective one ends thereof affixed to said bracket and said headrail by a first fastener that is directly inserted through said curtain, said at least one elastic member, said bracket and said headrail to affix said curtain and said at least one elastic member to said bracket and said headrail; said bracket has an opposite segment thereof fastened to said curtain and said at least one elastic member by a second fastener that is inserted through said bracket, said curtain and each said elastic member to affix said curtain and said at least one elastic member to said bracket; and a slat, wherein said curtain and each said elastic member have respective opposite ends thereof fastened to and winding around said slat; said clamp is adapted for clamping said slat and the respective opposite ends of said curtain and said at least one elastic member remote from said headrail;

wherein the clamp is configured such that pressing said press portion of said clamp toward said support arm causes said clamping arm to be opened, said curtain is rolled up or extended out with said at least one elastic member; and the clamp is further configured such that releasing the applied pressure from said press portion causes said clamping arm to be clamped on said support arm again to secure said curtain and said at least one elastic member in a predetermined condition.

3. A window shade, comprising:

a headrail comprising a first fastening member;

a curtain comprising a top end, an opposing bottom end, a second fastening member located at said top end to face toward said first fastening member of said headrail and adapted for fastening to said first fastening member of said headrail;

at least one elastic member bonded to said curtain, each said elastic member having one end thereof fixedly fastened to said second fastening member of said curtain;

a clamp comprising a support arm, a clamping arm and a press portion, said clamping arm having one end thereof connected to one end of said support arm and an opposite end thereof clamped on an opposite end of said support arm such that an accommodation space is defined in between said support aim and said clamping arm, said press portion being connected to a body part of said clamping arm to face toward said support arm, said clamp being adapted for clamping said curtain and an opposite end of each said elastic member remote from said headrail for allowing said curtain and said at least one elastic member to be received in said accommodation space of said clamp in a rolled up condition;

a bracket mounted between said headrail and said at least one elastic member, said curtain and each said elastic member have respective one ends thereof affixed to said bracket and said headrail by a first fastener that is directly inserted through said curtain, said at least one elastic member, said bracket and said headrail to affix said curtain and said at least one elastic member to said bracket and said headrail, said bracket has an opposite segment thereof fastened to said curtain and said at least one elastic member by a second fastener that is inserted through said bracket, said curtain and each said elastic member to affix said curtain and said at least one elastic member to said bracket; and a slat, wherein said curtain and each said elastic member have respective opposite ends thereof fastened to and winding around said slat; said clamp is adapted for clamping said slat and the respective opposite ends of said curtain and said at least one elastic member remote from said headrail;

wherein the clamp is configured such that pressing said press portion of said clamp toward said support arm causes said clamping arm to be opened, said curtain is rolled up or extended out with said at least one elastic member; and the clamp is further configured such that releasing the applied pressure from said press portion causes said clamping arm to be clamped on said support arm again to secure said curtain and said at least one elastic member in a predetermined condition.

* * * * *